United States Patent [19]

Lehman

[11] 4,261,135

[45] Apr. 14, 1981

[54] FINGER FLICKER FLYING SAUCER TOY

[76] Inventor: James A. Lehman, 314 Wisconsin Ave., El Cajon, Calif. 92020

[21] Appl. No.: 971,705

[22] Filed: Dec. 21, 1978

Related U.S. Application Data

[63] Continuation-in-part of Ser. No. 830,584, Sep. 6, 1977, abandoned.

[51] Int. Cl.[3] ..... A63H 27/00

[52] U.S. Cl. ..... 46/74 D; 273/424

[58] Field of Search ..... 46/74 D, 75, 1 R; 273/425, 424, 317, 327; D21/85, 86, 2, 4

[56] References Cited

U.S. PATENT DOCUMENTS

| | | | |
|---|---|---|---|
| D. 241,565 | 9/1976 | Molenaar | D21/85 |
| 1,683,643 | 9/1928 | Wittmaak | 273/427 X |
| 2,953,378 | 9/1960 | LaVeigne, Jr. | 273/327 |
| 3,590,518 | 7/1971 | LeBaron | 46/74 D X |
| 3,828,466 | 8/1974 | Geiger | 46/74 D |
| 3,959,915 | 6/1976 | Kettlestrings | 46/74 D |

*Primary Examiner*—Gene Mancene
*Assistant Examiner*—Mickey Yu
*Attorney, Agent, or Firm*—Frank D. Gilliam

[57] ABSTRACT

The invention pertains to a small hand tossed flying saucer toy that is slightly larger than the partially closed fist of the user so that it rests on the hand over the end of the fist. At least one internal launching tab is provided for launching the toy by a flick of the user's finger against the tab. The upper surface of the toy may completely cover the fist, may be shaped generally like a doughnut with an open center area or be formed with openings therethrough.

11 Claims, 11 Drawing Figures

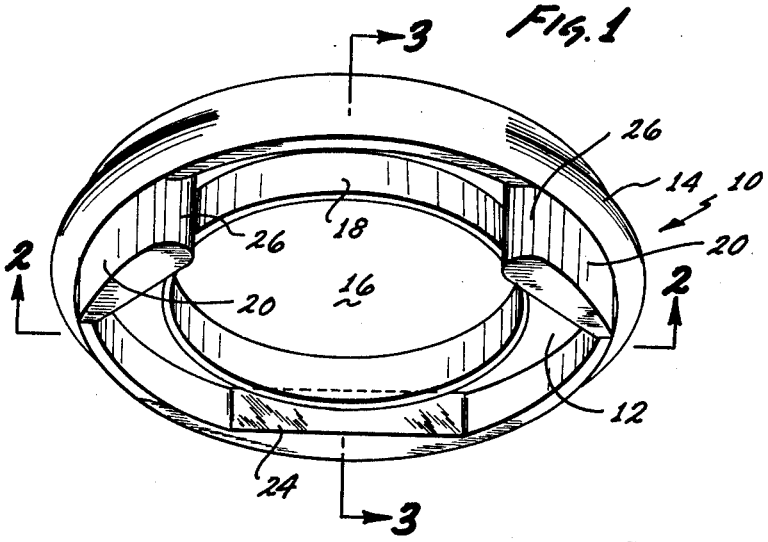
FIG. 1
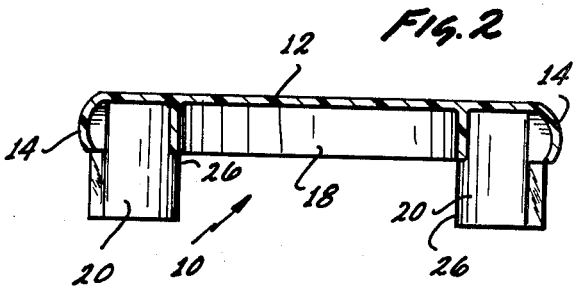
FIG. 2
FIG. 3
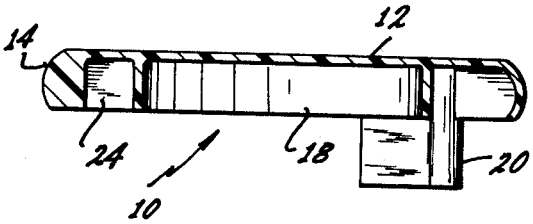
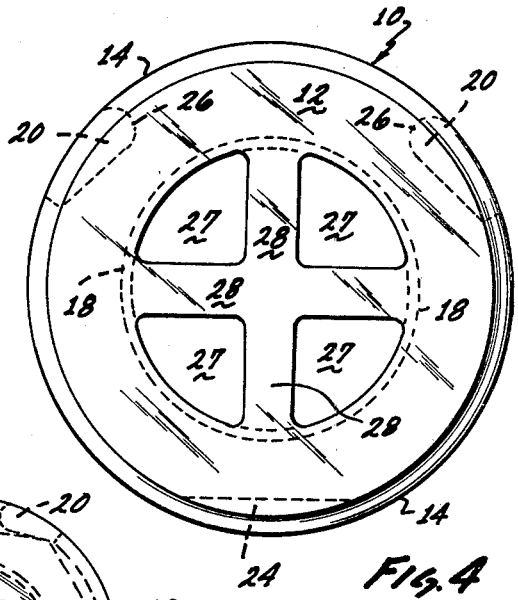
FIG. 4
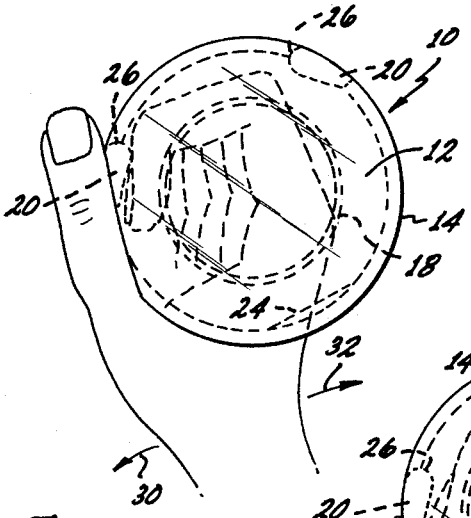
FIG. 5
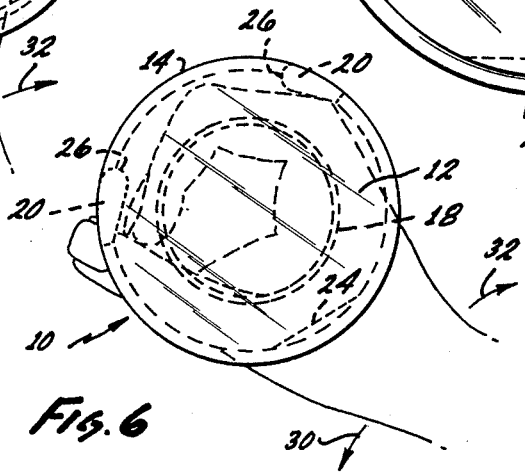
FIG. 6

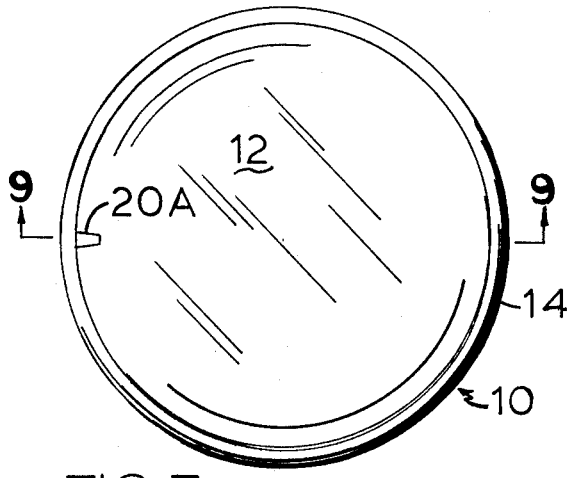
FIG. 7
FIG. 8
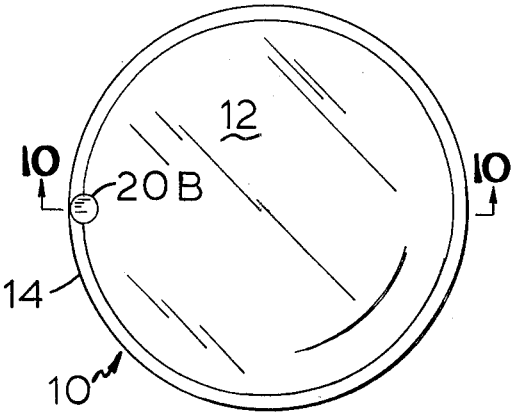
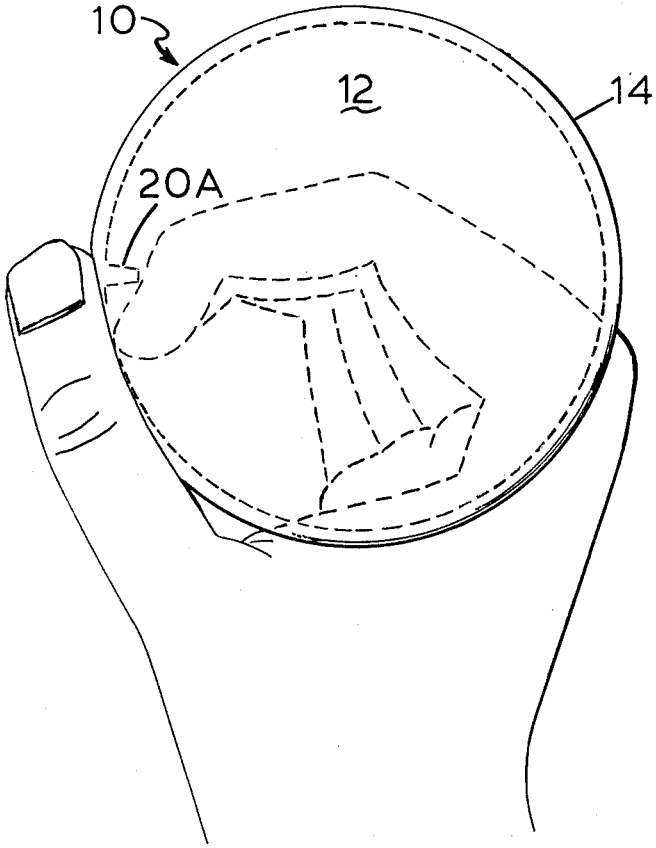
FIG. 11
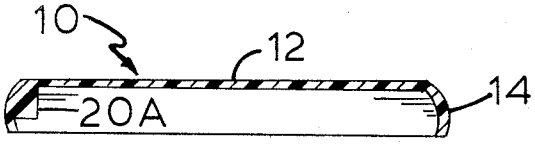
FIG. 9
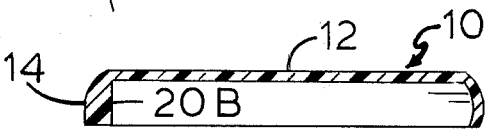
FIG. 10

FINGER FLICKER FLYING SAUCER TOY

This application is a continuation-in-part of Ser. No. 830,584 filed 9/6/77 now abandoned.

BACKGROUND OF THE INVENTION

Flying saucer toys have become increasingly popular during the past years. A typical saucer is circular with a depending air foil configured peripheral flange or lip and aside from some slight changes from an accurate cross-section, and the possible addition of a few annular ridges on top, has not changed appreciably in common usage since its inception. Although saucer toys small in physical size exist, they take the general configuration of the conventional saucer toy and are launched into flight by the same manner.

Although the entertainment value of tossing these saucers is undeniable, there are certain deficiencies in the basic toy as presently designed which it is attempted to remedy by the invention disclosed herein. Because the toy takes the standard form it must be propelled by grasping its outer lip and then propelled by arm and wrist movement. When the size of the saucer is small, tossing in this manner reduces the accuracy of the tosser when a specific target has been selected. Also, the speed with which the unit is thrown may be somewhat limited by the necessity of disengaging the fingers from beneath the lip as it is released as a firm engagement of these fingers is an absolute necessity to impact an ideal spin to the toy. These toys, because of their usual construction from lubricious materials, are nearly impossible to grab hold of for use, especially when the outer surface is wet.

SUMMARY OF THE INVENTION

The instant invention alleviates the above deficiencies by providing a small saucer toy that rests on the thumb and forefinger of a partially closed fist of the user. Around the inner surface of the lip is at least one launching tab, which engages the forefinger and causes the saucer toy to be launched into flight when the forefinger is abruptly opened or flicked from its partial fist position. A ring symetrical with the vertical center line of the saucer toy may be provided for a hand rest for the saucer. This hand rest may define the edge of a central opening in the saucer upper surface or body. In another embodiment, the upper surface of the saucer toy is formed by a pair or perpendicular cross-members with openings therebetween and the lip of the saucer toy.

The tab or tabs may extend above, even with or below the lip of the saucer toy and the symetrical ring support member. A rest tab may also be provided for resting on the hand and providing a counter balance when two tab members are provided.

BRIEF DESCRIPTION OF THE DRAWINGS

FIG. 1 is an elevated perspective view of the saucer toy showing an upper body portion, a curve-linear lip, an open center portion, two tab members and support member.

FIG. 2 is a cross-section of FIG. 1 taken along line 2—2.

FIG. 3 is a cross-section of FIG. 1 taken along line 3—3.

FIG. 4 is a plan view of the instant invention showing openings in the upper body portion.

FIG. 5 shows the saucer toy of the instant invention resting on a partially closed fist with the thumb positioned outside and resting on the upper lip surface of the saucer toy.

FIG. 6 shows the saucer toy of the instant invention resting on a partially closed fist with the thumb beneath the lip and substantially within the perimeters of the lip.

FIG. 7 is a bottom plan view of the instant invention showing one rectilinear tab/leg member.

FIG. 8 is a bottom plan view of the instant invention showing one curvilinear tab/leg member.

FIG. 9 is a cross-section of FIG. 7 taken along line 9—9.

FIG. 10 is a cross-section of FIG. 8 taken along line 10—10.

FIG. 11 shows the saucer toy of FIG. 7 resting on a partially closed fist with the thumb positioned outside and resting on the upper lip surface of the toy.

DETAILED DESCRIPTION OF THE EMBODIMENTS

The same reference numerals are used throughout the specifications and drawings to depict the indentical part or element.

Referring now specifically to FIG. 1, a flying saucer toy 10 is shown which is typical in general configuration as existing toy saucers, having a central body portion 12 and an air foil curvilinear depending lip 14. In this embodiment, the central body portion 12 has an opening 16, a ring member 18 forming the surface of the opening, a pair of finger grip/legs 20 formed between the lip 14 and the ring member 18 and a rest counter balance member 24. The finger grip/legs 20 are formed to rest against the lip 14 and central body portion 12 and taper substantially rectilinearly outward toward end 26. The grip/legs 20 are positioned, for example, in the first and third quadrant of the saucer toy. The ends 24 are adjacent to each other and provide for either right or left hand users of the toy. The rest member 24 is for example symetrically positioned between quadrants three and four of the saucer toy central body portion. It should be understood that the grip/legs 20 and the rest member 24 may be positioned in any selected positions depending on the desired flight path of the saucer toy 10. Positioned as shown, the saucer toy is substantially balanced for straight flight.

The grip/legs 20, the rest member 24, and the ring member 18 may be cast or formed as a part of the saucer or may be formed separate and attached by any convenient means, such as, but not limited to an adhesive.

The showing of FIG. 2 is taken along line 2—2 of FIG. 1, this embodiment is like that of FIG. 1 except that the central body portion 12 has no opening 16. The central body portion, grip/legs 20, lip 14 and ring member 18 are clearly shown.

The showing of FIG. 3 is taken along line 3—3 of FIG. 1, and shows the central body portion 12, lip 14, ring member 18, one grip/leg 20 and rest counter balance member 24. Like FIG. 2, FIG. 3 shows a solid central body portion 12.

FIG. 4 is a plan view of the saucer toy similar to the other figure showings except the central body portion includes four cutouts 27 that form a pair of crossed blades 28. Although four cutouts 27 are shown, any convenient number may be used to practice the invention.

The entire saucer toy may be constructed of any material suitable for the purpose for which a saucer toy is generally intended, such as, but not limited to various types of plastic. Hard plastic for outdoor use and soft plastic for indoor use is preferred.

Alternate configurations are shown in FIGS. 7-10.

The FIG. 7 embodiment, seen in cross-section in FIG. 9, has a single grip/leg 20A and the rest counter balance 24 and ring member 18 are omitted. The grip/-leg 20A takes the form of a inwardly tapered rectilinear member that is shorter in length than the depending lip 14. The single grip/leg of FIG. 7 is of such a small size and resulting light weight that normal flight is maintained without the need of any opposite counter balancing weight means.

The FIG. 8 embodiment, seen in cross-section in FIG. 10, is the same as the FIG. 7 embodiment except the single grip/leg 20B is curvilinear in form and extends the same distance as the depending leg 14.

FIGS. 5, 6, and 7 show various ways that the saucer toy may be launched into flight.

In FIGS. 5 and 11, the saucer toy rests on top of the user's partially closed fist. In FIG. 5, the ring member 18 rests on the forefinger and the rest counter balance member 24 rests on the hand between the wrist and fingers. In FIG. 11, the inner body 12 of the saucer toy rests on the hand between the forefinger and the wrist. The tip of the forefinger is placed against grip/leg 20, 20A, 20B and the thumb is placed over the depending lip 14 and rests partially on the upper surface of body portion 12. When the saucer toy is in this position it is ready to be launched, which is accomplished by flicking the forefinger in an outward manner causing the saucer toy 10 to abruptly leave the user's hand.

FIGS. 5, 6, and 7 show the various ways by which the saucer toy 10 may be launched into flight. In FIG. 5 the saucer toy 10 rests on the top of the user's partially closed fist. The ring member 18 rests on the forefinger and the rest counter balance member 24 rests on the hand between the wrist and fingers. The forefinger is placed against one grip/leg 20 and the thumb is placed over the lip 14 and rest partially on the central portion 12. When the saucer toy is in this position it is ready to be launched, which is accomplished by flicking the forefinger in an outward manner causing the saucer toy 10 to abruptly leave the user's hand.

In FIG. 6, the saucer toy 10 rests on the hand in a manner similar to FIGS. 5 and 11. In this method of launching, the nail end of the forefinger rests against one grip/leg 20 while the knuckle of the forefinger rests against the other grip/leg 20 and the thumb except for a portion of the nail is rested beneath the central body portion 12 of the saucer toy 10. The forefinger is flicked in the same manner to launch the saucer toy.

Snapping the wrist first along arrow 30 then toward 32 gives added propulsion to the flight of the flying saucer toy 10.

It should be noted that the grip/legs 20 extend either below, even with or above the lower surface of the lip 14. When extending below, they act as support legs when the device lands on a flat surface which allows easy pick-up of the saucer toy from a flat smooth surface.

The general diameter of the device is only limited by the various size of the hands of the users, obviously the size may range slightly for different age groups, etc.

Many changes may be made in the details of the instant invention, in the method and material of fabrication, in the configuration and assemblage of the constituent elements, without departing from the spirit and scope of the appended claims, which changes are intended to be embraced therewithin.

Having thus described the invention, what is claimed as new and useful and desired to be secured by United States Letters Patent is:

1. A hand-held finger-flickable flying saucer toy comprising:

a central body portion, slightly larger than the closed fist of a human hand;

a curvi-linear air foil configured depending lip is positioned around the periphery of said central body portion; and at least one launching tab extending toward the center of said central body portion and fixedly secured to the inner surface of said central body portion and said depending lip whereby said flying saucer toy is launched by positioning on said closed fist and flexing the index finger against said launching tab.

2. The invention as defined in claim 1, wherein a ring member is fixedly secured to said central body portion and coaxial with the vertical center line thereof.

3. The invention as defined in claim 2, wherein a rest member is provided fixedly secured to the inner surface of said central body portion and said depending lip.

4. The invention as defined in claim 3, wherein said central body portion has an aperture therethrough.

5. The invention as defined in claim 4, wherein said aperture is substantially the same diameter as said ring member.

6. The invention as defined in claim 1, wherein said central body portion comprises a plurality of apertures therethrough, said apertures forming two perpendicular blades passing through the center of said central body portion.

7. The invention as defined in claim 1, wherein said at least one launching tab extends from said central body portion below said depending lip.

8. The invention as defined in claim 1, wherein said at least one launching tab extends from said central body portion a distance equal to the lower edge of said lip member.

9. The invention as defined in claim 1, wherein said at least one launching tab extends from said central body portion a dsitance less than the lower surface of said lip member.

10. The invention as defined in claim 1, wherein said at least one launching tab is curvi-linear.

11. The invention as defined in claim 1, wherein said at least one launching tab is recti-linear.

* * * * *